US005351459A

United States Patent [19]

Kassl et al.

[11] Patent Number: 5,351,459

[45] Date of Patent: Oct. 4, 1994

[54] STRENGTH AND DECORATION WINDOW GRID SYSTEM

[76] Inventors: Robert A. Kassl, 68 Factory Pond Rd., Locust Valley, N.Y. 11560; Robert N. Kassl, 15 Sparrow La., Huntington, N.Y. 11746

[21] Appl. No.: 988,826

[22] Filed: Dec. 10, 1992

[51] Int. Cl.[5] ..... E04D 1/00

[52] U.S. Cl. ..... 52/656.5; 52/456

[58] Field of Search ..... 52/456, 476, 656.1, 52/656.5, 656.6, 656.8, 664, 665, 666, 667, 311.2, 311.3, 656.9; 49/50

[56] References Cited

U.S. PATENT DOCUMENTS

| | | | |
|---|---|---|---|
| 2,032,693 | 3/1936 | Fries et al. | 52/456 |
| 3,358,412 | 12/1967 | Martin | 52/665 X |
| 3,372,522 | 3/1968 | Engstrom | 52/456 |
| 3,386,219 | 6/1968 | Beil | 52/456 |
| 3,474,587 | 10/1969 | Martin | 52/456 |
| 4,060,950 | 12/1977 | Rackarn et al. | 52/665 X |
| 4,437,284 | 3/1984 | Cribben et al. | 52/456 |
| 4,702,055 | 10/1987 | Ralph | 52/456 |
| 4,970,840 | 11/1990 | Ouellette et al. | 52/656.5 X |

FOREIGN PATENT DOCUMENTS

| | | | |
|---|---|---|---|
| 234148 | 5/1911 | Fed. Rep. of Germany | 52/664 |
| 2530703 | 1/1984 | France | 52/665 |
| 367154 | 6/1939 | Italy | 52/308 |
| 23981 | of 1899 | United Kingdom | 52/456 |

*Primary Examiner*—Peter M. Cuomo
*Assistant Examiner*—Jerry Redman
*Attorney, Agent, or Firm*—Bauer & Schaffer

[57] ABSTRACT

An improved strength and decoration window grid system is provided for a window having a sash and at least one window pane. The system consists of a mechanism for connecting vertical extruded profile bars to horizontal extruded profile bars to form a strong grid pattern. The ends of the vertical extruded profile bars and the ends of the horizontal extruded profile bars are secured to the inner sides of the sash against the at least one window pane of the window to divide the window pane into a plurality of lights. This will substantially increase strength to the window to prevent twisting, horizontal load pressure and vertical load pressure thereto, while giving real optical enrichment to the window.

9 Claims, 4 Drawing Sheets

C
C
14
20
22
A
B
11
12
26
24
16
B
44
22
18
16
C
C 12
14
20
16
11
22
26
24
44
18
5

44
52
46
50
54
50
48
44
52

STRENGTH AND DECORATION WINDOW GRID SYSTEM

BACKGROUND OF THE INVENTION

1. Field of the Invention

The instant invention relates generally to georgian grille windows and more specifically it relates to an improved strength and decoration window grid system.

2. Description of the Prior Art

Numerous georgian grille windows have been provided in prior art that are adapted to include various shaped profile bar sections with different types of connectors to be used in forming lattice type patterns on windows in buildings. While these units may be suitable for the particular purpose to which they address, they would not be as suitable for the purposes of the present invention as heretofore described.

For example, on a single window frame where there are twenty five lights by necessity, sixteen straight connector and twenty four profile bars would be required.

SUMMARY OF THE INVENTION

A primary object of the instant invention is to provide an improved strength and decoration window grid system that will overcome the shortcomings of the prior art devices.

A main object is to provide an improved strength and decoration window grid system that may best be seen when applied to a multiple light window; for example a twenty five light window when constructed with the instant invention will contain eight extruded profile bars and eight connector rods compared to the prior art having sixteen straight connectors and twenty four profile bars.

Another main object is to provide an improved strength and decoration window grid system that will produce a major labor saving during fabrication on the window.

Another object is to provide an improved strength and decoration window grid system that will substantially increase a window frame assembly strength to prevent twisting, horizontal load pressure and vertical load pressure thereto.

An additional object is to provide an improved strength and decoration window grid system in which vertical extruded profile bars and cooperating horizontal extruded profile bars are connected together to give real optical enrichment to the window, while retaining a facades expressiveness in an edifice.

A further object is to provide an improved strength and decoration window grid system that is simple and easy to use.

A still further object is to provide an improved strength and decoration window grid system that is economical in cost to manufacture and to the consumer.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Figure 5:
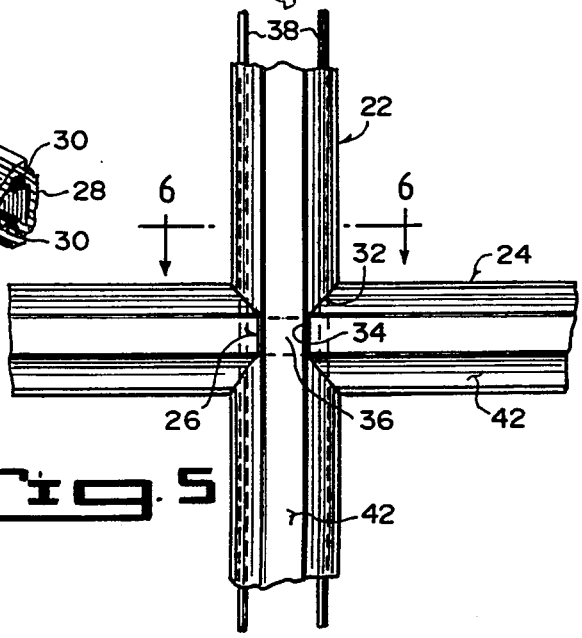
FIG. 5 is an enlarged front elevational view taken in direction of arrow 5 in FIG. 2, showing a portion of the vertical extruded profile bar and the horizontal extruded profile bar connected together at their double mitered mating cutout area cross joint.
Figure 7:
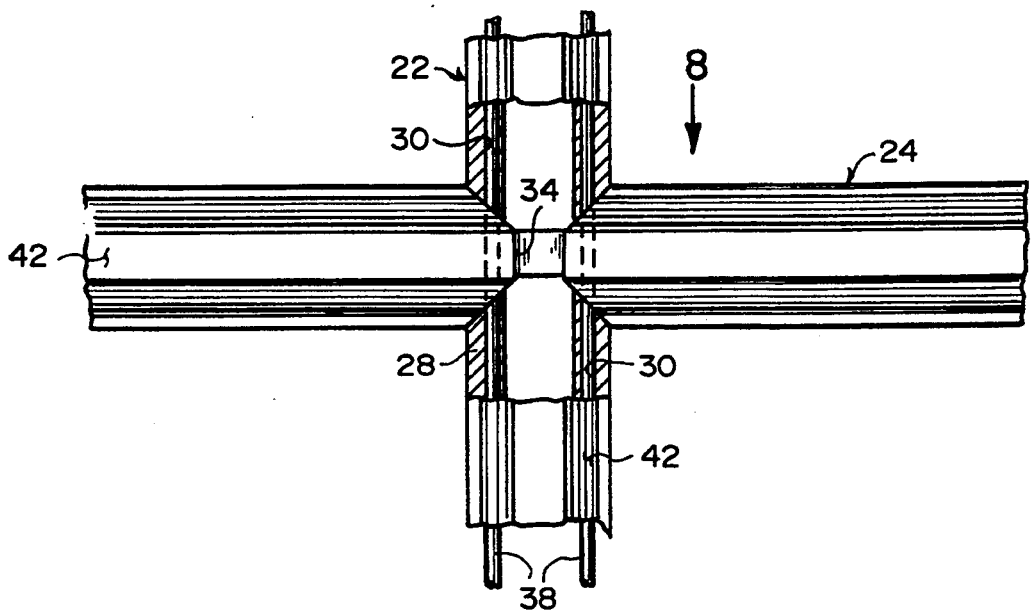

FIG. 7 a front elevational view similar to FIG. 5 with the vertical extruded profile bar broken away and in section at the double mitered mating cutout area cross joint.

Figure 8:
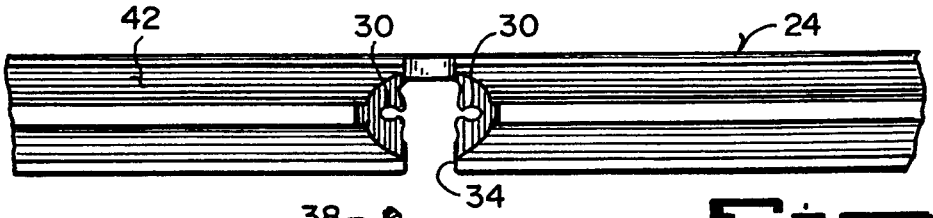

FIG. 8 is a top view taken in direction of arrow 8 in FIG. 7 of just the horizontal extruded profile bar per se.

Figure 9:
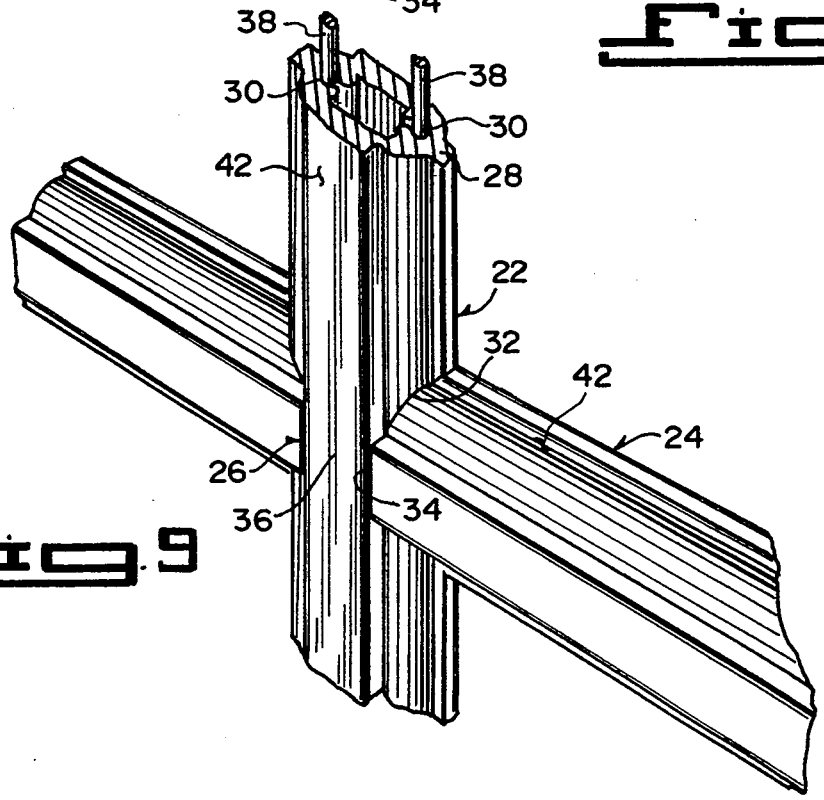

FIG. 9 is a front perspective view as of FIG. 5.

Figure 10:
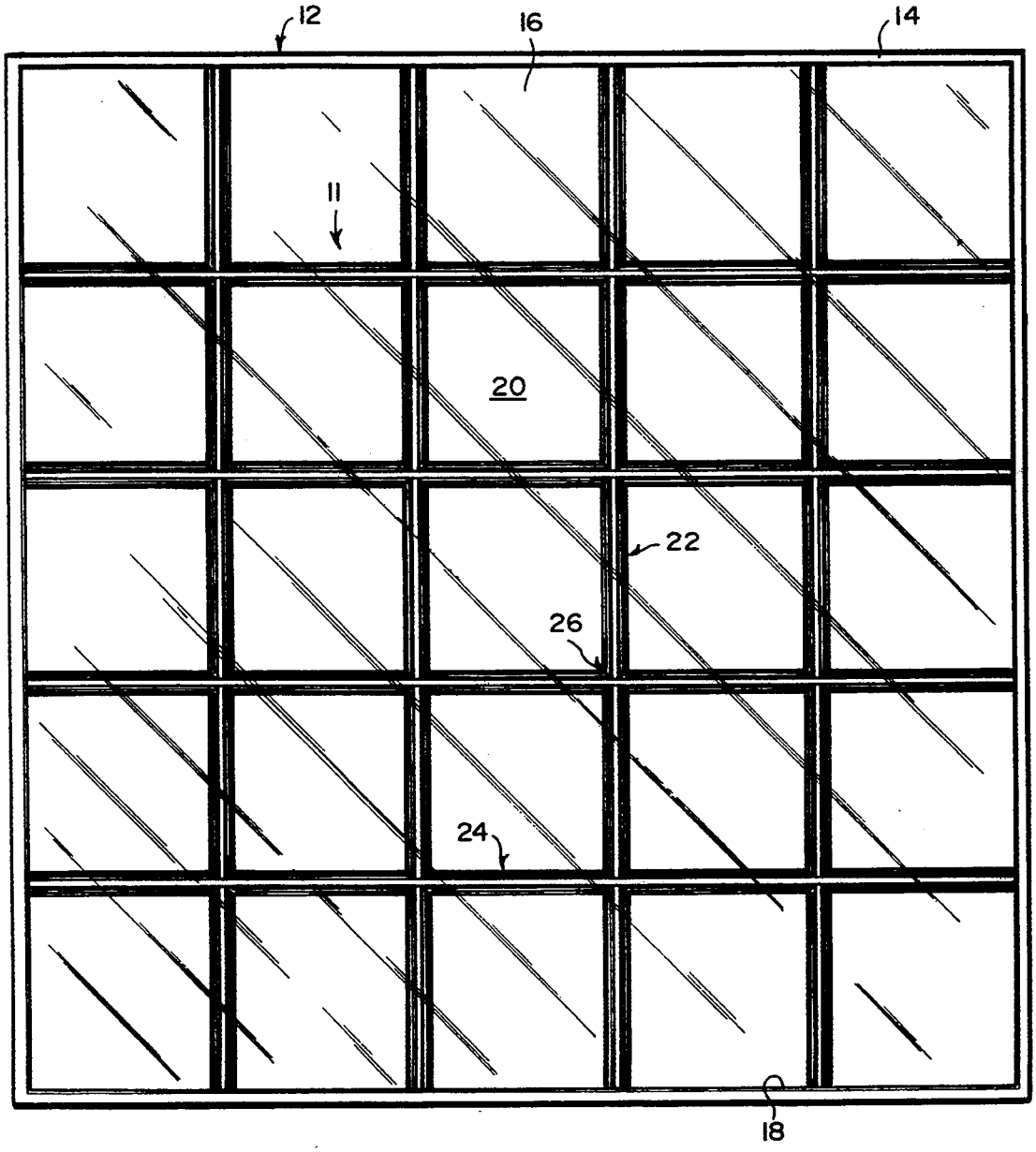

FIG. 10 is a front elevational view of the instant invention installed on a window to divide the window pane into twenty five lights.

DETAILED DESCRIPTION OF THE PREFERRED EMBODIMENTS

Figure 1:
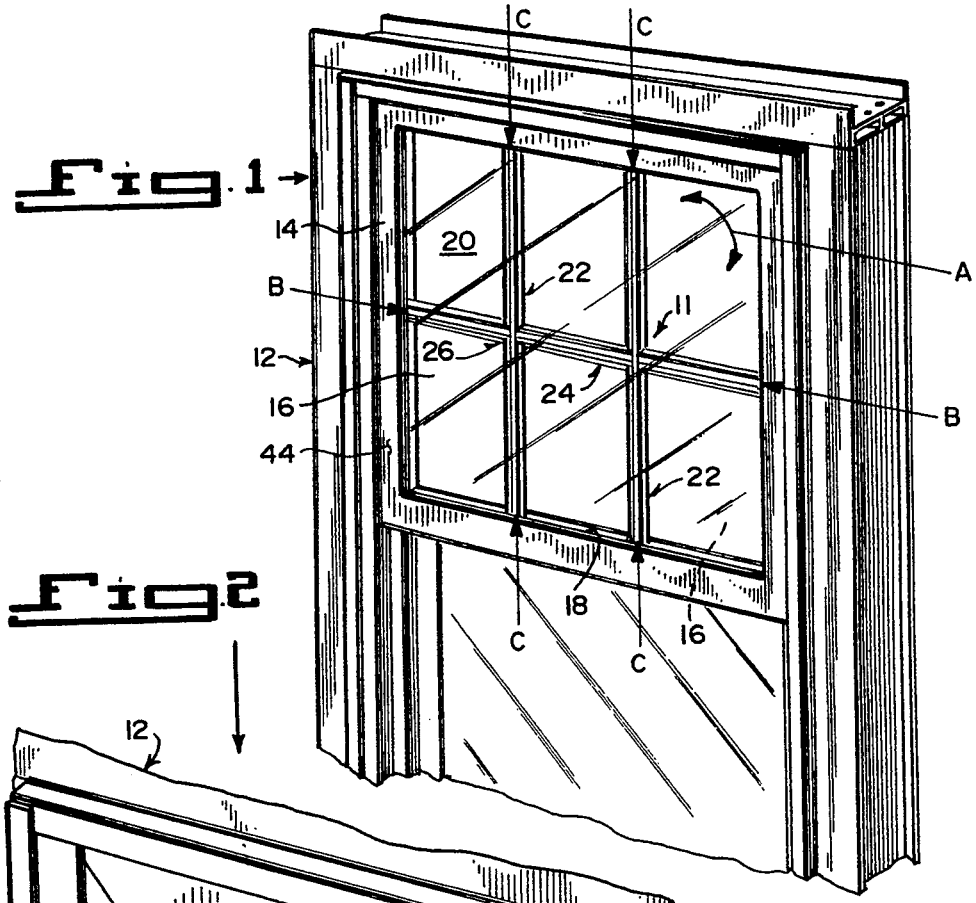
FIG.1 is a perspective view of an window with its lower portion broken away, showing the instant invention installed thereto.
Figure 3:
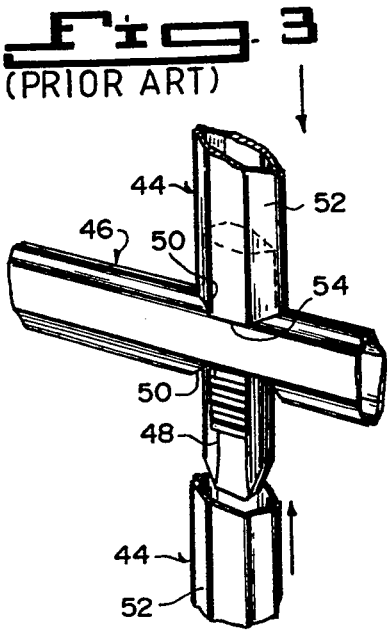
Fig. 3 (PRIOR ART)
FIG. 3 is a perspective view of a portion of the prior art showing interconnecting profile bars with a straight connector therebetween.
Figure 4:
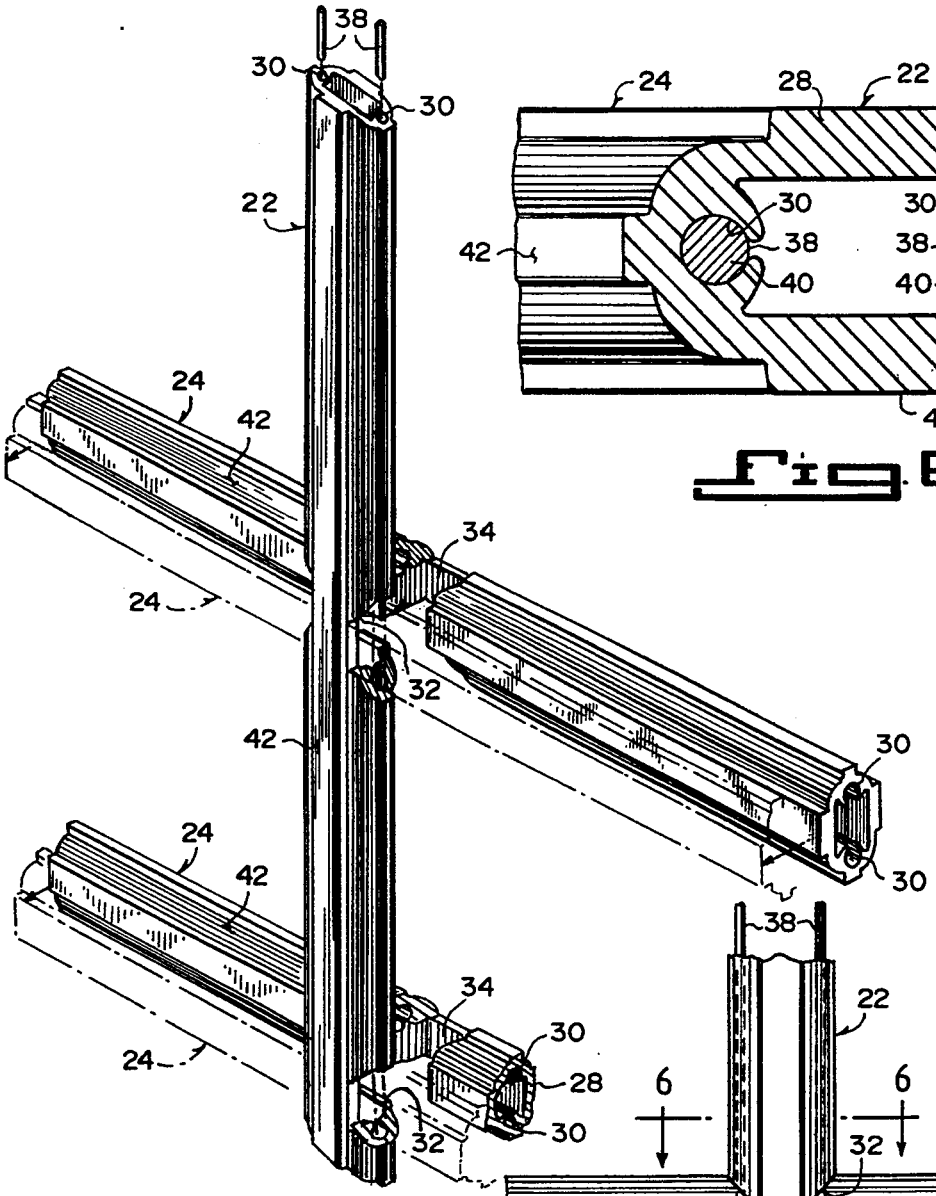
FIG. 4 is an enlarged exploded perspective view of part of the instant invention being a portion of a vertical extruded profile bar and two cooperating horizontal extruded profile bars ready to be connected together.
Figure 6:
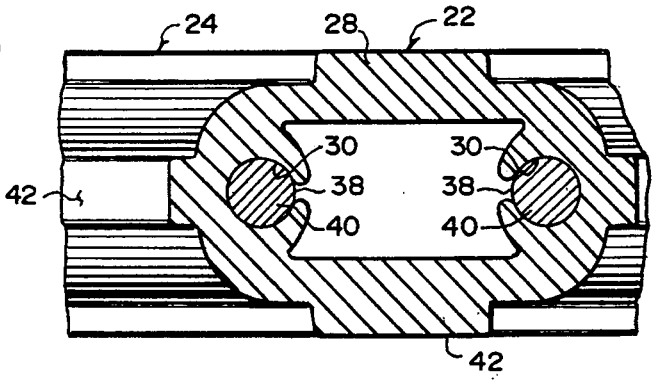
FIG. 6 is a greatly enlarged cross sectional view taken along line 6—6 in FIG. 5.

Turning now descriptively to the drawings, in which similar reference characters denote similar elements throughout the several views, all the Figures except FIG. 3, illustrate an improved strength and decoration window grid system 11 for a window 12 having a sash 14 and at least one window pane 16. The system 11 consists of a plurality of vertical extruded profile bars 22 and a plurality of horizontal extruded profile bars 24. A mechanism 26 is for connecting the vertical extruded profile bars 22 to the horizontal extruded profile bars 24 to form a strong grid pattern. The ends of the vertical extruded profile bars 22 and the ends of the horizontal extruded profile bars 24 are secured to the inner sides 18 of the sash 14 against the at least one window pane 16 of the window 12 to divide the window pane 16 into a plurality of lights 20. This will substantially increase strength to the window 12 to prevent twisting A, horizontal load pressure B and vertical load pressure C thereto, as shown in FIG. 1, while giving real optical enrichment to the window 12.

Each vertical extruded profile bar 22 and horizontal extruded profile bar 24 is fabricated out of a durable hollow aluminum alloy material 28. Each vertical extruded profile bar 22 and horizontal extruded profile bar 24 contains a pair of internal oppositely spaced, curved in cross section, elongated tracks 30 running the full length thereof.

Each connecting mechanism 26 includes each vertical extruded profile bar 22 having a double mitered cutout area 32 extending across the tracks 30 and each horizontal extruded profile bar 24 having a double mitered cutout area 34 extending across the tracks 30. When the double mitered cutout area 32 of one vertical extruded profile bar 22 is transversely paced into the double mitered cutout area 34 of one horizontal extruded profile bar 24 a mating cross joint 36 is formed therebetween.

Each connecting mechanism 26 further contains a pair of elongated connector rods 38, insertable into the pair of tracks 30 in either of the vertical/horizontal extruded profile bar 22/24 when in the mating cross joint 36 is formed therebetween. This will keep the vertical extruded profile bar 22 retained to the horizontal extruded profile bar 24 in the strong grid pattern.

Each vertical extruded profile bar 22 is shaped to simulate a vertical muntin for the sash 14 of the window 12. Each horizontal extruded profile bar 24 is shaped to simulate a horizontal muntin for the sash 14 of the window 12.

Each elongated connector rod 38 is cylindrical shaped and is fabricated out of a durable metal material 40. Each vertical extruded profile bar 22 and each horizontal extruded profile bar 24 can be coated in one of a variety of matching colors 42 to coordinate with the color 44 of the sash 14 of the window 12. The colors 42 can include different wood grain colors with a graining hard to differentiate from genuine wood.

FIG. 3 shows the prior art being two thin interconnecting profile bars 44 and 46 of inferior quality. A straight plastic connector 48 is inserted transversely through two opposite mitered portion 50 in the horizontal profile bar 46. Two segments 52 of the vertical profile bar 44, each having a mitered end 54, are inserted onto the straight plastic connector 48. This will provide a weak cross joint connection and will not add strength to a window.

FIG. 10 shows the improved strength and decoration grid system 11 applied to a window 12 that contains twenty five lights 20. When the system 11 is constructed it will contain eight extruded profile bars, in which four will be vertical extruded profile bars 22 and four will be horizontal extruded profile bars 24. Eight connector rods 38 will be needed to complete the system 11. If it was made with the prior art sixteen straight connectors 48, twenty vertical profile bars 44 and four horizontal profile bars 46 will be required.

Figure 2:
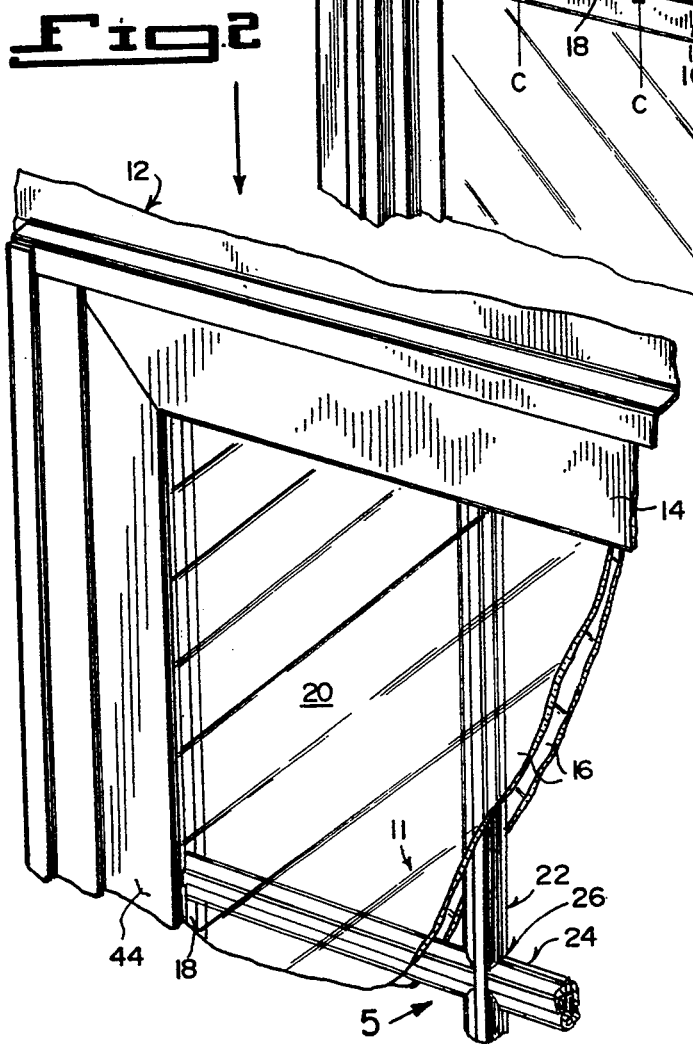
FIG. 2 is an enlarged perspective view of a portion of the window and the instant invention shown in FIG. 1.

The improved strength and decoration grid system 11 can be placed within a cavity between two window panes 16 in an insulated window 12, as shown in FIGS. 1, 2 and 10. It can also be placed against one window pane 16 in a regular window 12, not shown in the drawings.

LIST OF REFERENCE NUMBERS

10 improved strength and decoration window grid system
12 window
14 sash in 12
16 window pane in 14
18 inner side of 14
20 light on 16
22 vertical extruded profile bar
24 horizontal extruded profile bar
26 connecting mechanism
28 durable hollow aluminium alloy material for 22 and 24
30 curved in cross section elongated track
32 double mitered cutout area in 22
34 double mitered cutout area in 24
36 mating cross joint
38 elongated connector rod
40 durable metal material for 38
42 color coated on 22 and 24
44 prior art vertical thin profile bar
46 prior art horizontal thin profile bar
48 straight plastic connector
50 mitered portion of 46
52 segment of 44
54 mitered end on 52

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A grid system for a window having a sash and at least one window pane, comprising at least one elongated vertical bar and one elongated horizontal bar arranged in a crossing grid pattern between the sides of the sash and dividing the pane into a plurality of lights, each one of said vertical and horizontal bars having a double mitered cutout in the area of the crossing with the other bar, said cutouts fitting transversely one within the other so that said vertical and horizontal bars form a mating joint with said crossing vertical and horizontal bars defining mitered corners, at least one elongated rod extending lengthwise through each of said bars interconnecting the transversely mating bars together.

2. The grid system according of claim 1, wherein said vertical and horizontal bars are formed with substantially identical profiles, having at least one pair of opposing continuous faces and the double mitered cutouts extend partially from one of said one pair of faces toward the other and at such depth so that upon mating said bars, a continuous vertical and horizontal face exists on each side of said grid.

3. A grid system for a window having a sash and at least one window pane comprising a plurality of elongated vertical profile bars and a plurality of elongated horizontal profile bars arranged in a crossing grid pattern within the sash to divide the pane into a plurality of lights, each of said bars having an identical exterior profile and at least one interior track running along the length of the bar and having at each crossing point with another bar a double mitered cutout extending across said track to a depth whereby said vertical and horizontal bars mate flush one within the other, said crossing vertical and horizontal bars providing a mitered corner joint conforming to the profile of said bars, including an elongated connector rail insertable in each of said tracks, respectively, to join said vertical and horizontal bars together at the crossing points.

4. The grid system according to claim 3, wherein the connecting rails form a fixed grid pattern, the ends of said vertical extruded profile bars and the end of said horizontal extruded profile bars being secured to the inner sides of the sash against the face of at least one window pane of the window to substantially increase strength to the window to prevent twisting of said sash under horizontal and vertical load pressure thereto.

5. The window grid system according to claim 4, wherein each said vertical and horizontal profiles bars is extruded from durable hollow aluminum alloy material.

6. The window grid system according to claim 3, wherein the at least one track comprises a pair of spaced cylindrical passageways and said connector rails are round rods.

7. The window grid system as recited in claim 3, wherein each said vertical and horizontal profile bar is shaped to simulate a vertical and horizontal muntin, respectively, for the sash of the window.

8. The window grid systems according to claim 3, wherein each said vertical and horizontal is coated in one of a variety of matching colors to coordinate with the color of the sash of the window.

9. A muntin for a grid system for a window having a sash, at least one window pane and crossing vertical and horizontal muntins connected together in an arrangement to divide the pane into a plurality of lights, said muntins comprising an elongated extruded profile member having at least one double mitered cutout formed along its length and an internal passageway running the length of said muntin through which a connecting rod is placed so that a plurality of said muntins may be arranged in a vertical and horizontal pattern between the sides of the sash with mating mitered cutouts seated one within the other to form a joint having mitered corners and interlocked by the connecting rods.

* * * * *

UNITED STATES PATENT AND TRADEMARK OFFICE

CERTIFICATE OF CORRECTION

PATENT NO. : 5,351,459

DATED : October 4, 1994

INVENTOR(S) : Kassl et al.

It is certified that error appears in the above-identified patent and that said Letters Patent is hereby corrected as shown below:

Claim 8, Column 6, line 3: change "systems" to --system--.

Claim 8, Column 6, line 4: after "horizontal" insert --profile bar--.

Signed and Sealed this

Tenth Day of January, 1995

Bruce Lehman

*Attest:*

BRUCE LEHMAN

*Attesting Officer*

*Commissioner of Patents and Trademarks*